US006206301B1

(12) United States Patent
Pruett

(10) Patent No.: US 6,206,301 B1
(45) Date of Patent: Mar. 27, 2001

(54) REVERSIBLE SPRAY NOZZLE

(76) Inventor: Phillip E. Pruett, 8915 Rosedale Hwy., Bakersfield, CA (US) 93312

( * ) Notice: Subject to any disclaimer, the term of this patent is extended or adjusted under 35 U.S.C. 154(b) by 0 days.

(21) Appl. No.: 09/353,421

(22) Filed: Jul. 15, 1999

(51) Int. Cl.[7] ..... B05B 15/02
(52) U.S. Cl. ..... 239/119; 239/116
(58) Field of Search ..... 239/114, 115, 239/116, 119, 123, 106, 104, 117, 118

(56) References Cited

U.S. PATENT DOCUMENTS 726,395 * 4/1903 Bedworth .
2,564,431 * 8/1951 Greenspoon et al. .
2,743,959 * 5/1956 Nelson et al. .
3,017,120 * 1/1962 Fraint et al. .
3,347,463 * 10/1967 Baker .
3,474,968 * 10/1969 Jackson .
4,869,430 * 9/1989 Good .
5,392,989 * 2/1995 Hurtig .
5,513,625 * 5/1996 Vorhis .

* cited by examiner

*Primary Examiner*—Andres Kashnikow
*Assistant Examiner*—Christopher S. Kim
(74) *Attorney, Agent, or Firm*—Don E. Erickson

(57) ABSTRACT

A reversible spray nozzle for use in a fluid dispersing system which consists of a nozzle portion defining a cylindrical channel therewithin, the nozzle portion having opposing ends, the opposing ends threaded for communicating with the fluid dispersing system, the cylindrical channel extending the length of the nozzle portion, the cylindrical channel for receiving a cylindrical flow tube; and the flow tube defining a delivery channel, the delivery channel extending the length of the flow tube, the delivery channel for providing a flow path for a fluid. The spray nozzle can be configured such that the flow tube is slideably disposed within the nozzle portion, and where the length of the flow tube is less than half of the length of the cylindrical channel of the nozzle portion.

11 Claims, 3 Drawing Sheets

REVERSIBLE SPRAY NOZZLE

FIELD OF THE INVENTION

The present invention relates to a spray nozzle for use in pressurized cooling and hydration systems, and more particularly to a reversible spray nozzle.

BACKGROUND OF THE INVENTION

Cooling/hydrating systems producing fine fluid sprays have been employed in various applications for many years. Such systems typically involve a pressurized fluid, usually water, escaping through a small orifice. The spray droplets produced by a standard nozzle are sufficiently small for agricultural applications, however, in evaporating systems, where a finer spray is required, the pressurized fluid, upon escaping through the small orifice, impinges on a proximate surface (pin jet nozzles). The force of the pressurized stress against the surface causes the fluid to disperse into minute particles creating a localized fog or mist.

Because of the difficulty in precisely cutting the small diameter orifice and delivery channel, prior art nozzles were typically formed from brass and other relatively soft metals. The short delivery channels of the prior art were necessary because of the limitations of metalworking. Cutting a narrow orifice, typically on the order of six one-thousandths of an inch (0.006 inch), was typically done with a pin drill, usually a stationary drill which engages rotating work. The depth which can be achieved with such a metalworking procedure, typically no greater than fifteen one-thousandths of an inch (0.015 inch), is chiefly a function of how well the drill bit can be supported during the metalworking process.

Further, the nature of the metalworking employed to cut the orifice and delivery channel was such that the integrity of the orifice and channel walls was difficult to maintain. The drilling operation was known to gouge and scar the interior surface of the delivery channel and leave an imprecise mouth to the orifice itself. Subsequently, some nozzles were produced in stainless steel, however such nozzles still followed the design of previous nozzles.

Recent developments in the production of nozzle inserts changed the manner in which spray nozzles have been manufactured. U.S. Pat. No. 4,869,430 to Good, describes an improved pin jet nozzle having a delivery channel of greater length, thereby producing better diffusion characteristics. The method of manufacturing provided a delivery channel with interior surface unmarked by metalworking and wherein the orifice had greater integrity. The novel concept of the '430 patent disclosed a delivery channel having the same diameter as the outlet orifice and having a length of at least three times its diameter. A blank base portion was drilled out to accommodate the insertion of an orifice component that was separately prepared. Thus, the blank base was drilled not with a pin drill, but with a drill of approximately sixty-two one-thousandths of an inch (0.062 inch). Because of the great difference in size, and since it was not intended to define an opening in the finished nozzle, this drilling procedure did not require the extreme accuracy of the drilling operation of the prior art.

FIGS. 1 and 2 describe typical spray nozzle assemblies of the prior art. In FIG. 1 the spray nozzle assembly is comprised of four components, nozzle portion 1, piston 2, spring 3 and filter portion 4. The nozzle portion 1 has a threaded exterior portion 7 for receipt in a fluid dispersing system and an internal threaded portion, not shown, for receipt of complementary threaded portion 9 of filter portion 4. Nozzle portion 1 has a cylindrical interior for receipt of piston 2, which piston 2 serves to regulate the amount of fluid through the spray nozzle assembly. Nozzle portion 1 has a fluid exit hole 5, and surface 6 of nozzle portion 1 is machined to mate with piston 2. Perpendicular cross-flow channels are inscribed in surface 6 to create a flow path for the fluid. Filter portion 4 forms a cylindrical interior for receipt of spring 3 and for communicating fluid to nozzle portion 1. The filter, not shown, is in the form of a wire mesh that is formed cylindrically about the external surface of filter portion 4 at point 8. When assembled, spring 3 is seated in filter portion 4, and is compressed against piston 2 to firmly bias piston 2 against surface 6. Fluid under pressure enters the nozzle assembly through filter portion 4, around piston 2, and exits the spray nozzle via the cross-flow channels and exit hole 5. The wire mesh filter of filter portion 4 is sized to block only larger impurities in the fluid, and does not impede smaller impurities which eventually clog exit hole 5. Although the nozzle assembly of FIG. 1 may be dissembled for cleaning, it is extremely difficult and time consuming to clear the impurities from exit hole 5, and consequently, the nozzle assembly is simply discarded.

FIG. 2 discloses a second prior art nozzle assembly that is comprised of a generally cylindrically shaped body 10, nozzle portion 11, and piston 12. Body 10 defines a cylindrical interior chamber 14 extending the length of cylindrical body 10, which chamber 14 provides a flowpath for the fluid. Body 10 has an insertion end 13, which is threaded for receipt in a fluid dispersing system, and a nozzle end for creating a fluid spray, the nozzle end having a circular recess for receiving the nozzle portion 11. Piston 12 is a piece of solid stock of approximately half the length of interior chamber 14, with one end of piston 12 having flow-channels inscribed thereon at 16 to create a flow path for the fluid. Piston 12 is contained within interior chamber 14 of body 10 at one end by nozzle portion 11, and at the other end by rolling over of body 10 at the edges of body 10 at interior chamber 14. Nozzle portion 11 is a circular plate, having an exit hole 15, creating a flow path for the fluid. After insertion of piston 12 in chamber 14, nozzle portion 11 is pressure inserted into a complementary circular recess in body 10. Body 10 and nozzle portion 12 are sized such that the composite surface of body 10 and nozzle portion 12 is smooth. When the spray nozzle assembly is threadably inserted in a fluid dispersing system, fluid pressure impels piston 12 firmly against the interior surface of nozzle portion 11. Fluid flows around piston 12, through the flow channels, and exits through exit hole 5.

However, even with the improved orifices and filters, such prior art nozzles are still subject to blockage due to impurities in the fluid. Under pressure, such impurities frequently lodge in the orifice of nozzle portion 11, and subsequently, the accumulation of impurities completely plugs passage of the fluid. Once plugged, it is highly impractical to clear out the orifice and re-use the nozzle. As a result, the spray nozzle must be replaced. Analysis of plugged nozzles has shown that the accumulation of impurities causing the blocking occurs at the surface of the exit holes in the interior of the nozzle portions.

OBJECTS OF THE PRESENT INVENTION

It is an object of the present invention to provide an improved spray nozzle that is capable of being cleared from plugging by fluid impurities by means of fluid flow. It is a further object of the present invention to provide an improved spray nozzle that may be reversibly inserted in the fluid delivery system. It is a still further object of the present invention to provide an improved spray nozzle that has a means for dislodging impurities that have lodged in the orifice of the spray nozzle.

According to the present invention, there is provided a reversible spray nozzle comprising a nozzle portion having a cylindrical channel therewithin extending the length of the nozzle portion, the nozzle portion having opposing ends, the opposing ends having screw threads for communicating with a fluid dispersing system, the cylindrical channel for receiving an flow tube, the flow tube having a delivery channel, the delivery channel extending the length of the flow tube, the delivery channel for providing a flow path for a fluid. When the flow path for the fluid becomes blocked due to the accumulation of impurities in the fluid, the spray nozzle is then reversed, and the reverse pressure from the dispersing system dislodges the impurities from delivery channel. In a second embodiment of the invention, the flow tube is shorter than the overall length of the nozzle, and slideably disposed within the nozzle portion, so that when the spray nozzle is reversed, fluid pressure impels the flow tube the length of the nozzle portion, and the impact force of the fluid pressure assists in dislodging the impurities.

BRIEF DESCRIPTION OF THE DRAWINGS

FIG. 3(*b*) is a side view of a second embodiment of the reversible spray nozzle of the present invention.

FIG. 4(*b*) is an end view of the reversible spray nozzle of FIG. 3(*b*).

DETAILED DESCRIPTION

Figure 1:
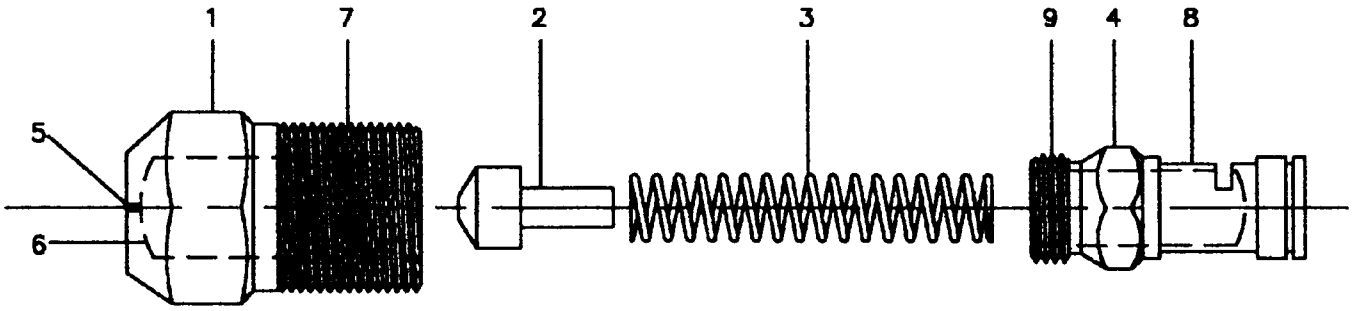
Fig. 1 ( Prior Art )
FIG. 1 is a shadow drawing of a prior art spray nozzle.
Figure 2:
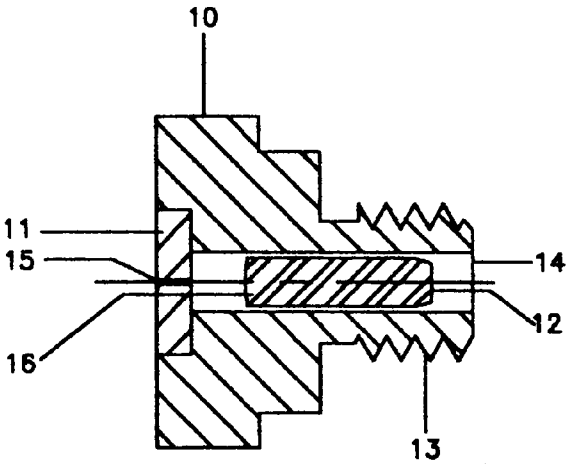
Fig. 2 ( Prior Art )
FIG. 2 is a cross-sectional drawing of a second prior art spray nozzle.
Figure 3A:
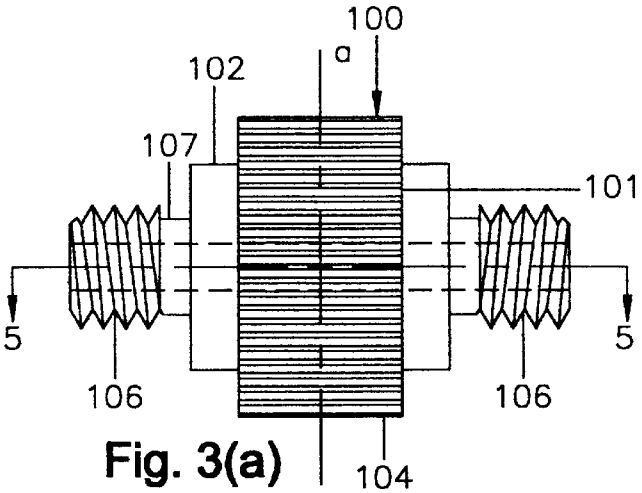
FIG. 3(*a*) is a side view of one embodiment of the reversible spray nozzle of the present invention.
Figure 3B:
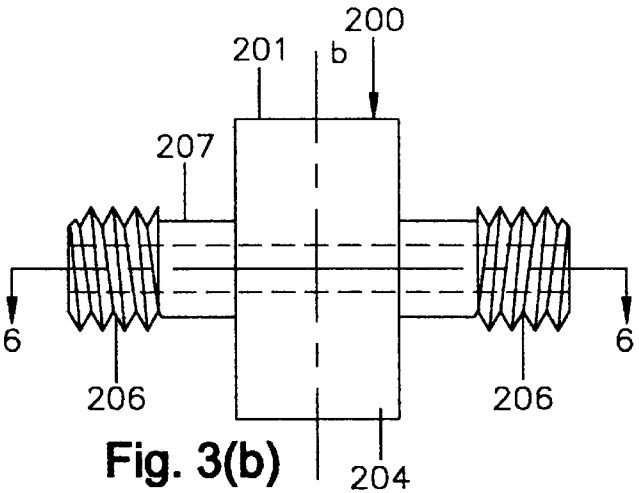

FIGS. 3, 4, 5, and 6 describe exemplary embodiments of spray nozzles of the invention. Referring now to FIGS. 3(*a*) and 3(*b*), side views of the spray nozzles 100 and 200 are shown which describe two different embodiments of the invention. In addition, such FIGS. 3(*a*) and 3(*b*) describe different external features, that being the respective surfaces 104 and 204 which are adapted for assisting the securing the spray nozzle to a fluid dispersing system. In FIG. 3(*a*), surface 104 is of a knurled geometry to provide a gripping surface for tightening either by hand, or by means of a tool, such as pliers. In FIG. 3(*b*), surface 204 describes a hex-head geometry to permit tightening of the spray nozzle 200 by means of pliers, wrench or socket wrench, or other similar tool. Said surfaces are not pertinent to the functional and inventive operation of the spray nozzle, but are provided solely to assist the user of the spray nozzle to insert such nozzle in the fluid dispersing system. Any other surface geometry could be utilized with the spray nozzles of the present invention without affecting the performance of the spray nozzles, and hence, the geometry of such surface is not a limitation of the scope of the invention.

Spray nozzles 100 and 200 are generally symmetrical about the lines a—a and b—b, respectively, and can be constructed from a single piece of stock which can be either machined or formed to have a generally cylindrical or hexagonal cross-section at surfaces 104 and 204. Shoulder 102 is formed to provide an abutment for seating spray nozzle 100 in an outlet of the fluid dispersing system. In the exemplary embodiment of FIG. 3(*a*) shoulder 102 is shown to be of smaller circumferential diameter than surface 104, however, such shoulder is shown for demonstration purposes only, and is not critical to the novelty of the invention described herein. Hence, spray nozzle 100 can function with or without shoulder 102, and/or, shoulder 102 can be of the same circumferential diameter as surface 104. FIG. 3(*b*) discloses spray nozzle 200 without shoulder 102. At opposing ends of spray nozzles 100 and 200, are threaded connectors 106 and 206, respectively, for threadedly communicating with outlet ports of a fluid dispersing system. The outside diameter of such threaded connectors 106 and 206 are sized to mate with standard fluid dispersing systems, for example, one such standard outside diameter is 0.375 inches. Shaft portions 107 and 207 may be provided for receiving o-rings to aid in providing a fluid seal against leakage.

Figure 4A:
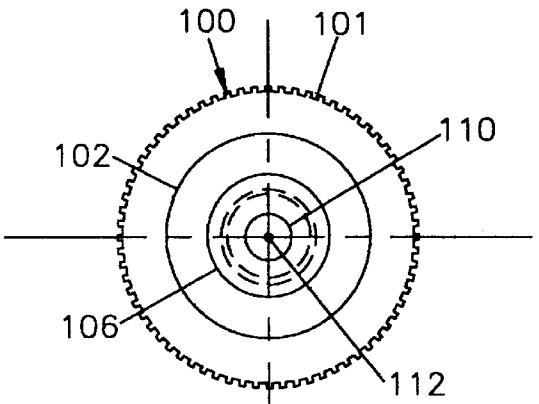
FIG. 4(*a*) is an end view of the reversible spray nozzle of FIG. 3(*a*).
Figure 4B:
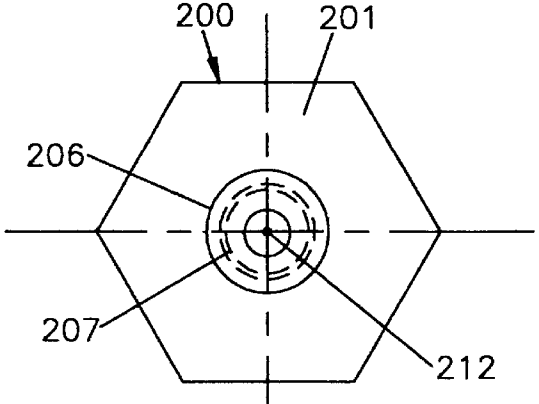

FIGS. 4(*a*) and 4(*b*) describe an end view of the reversible spray nozzles of FIGS. 3(*a*) and 3(*b*). As is shown by said figures, the only apparent differences are the surface geometrys. FIGS. 4(*a*) and 4(*b*) also show delivery channels 112 and 212 for the fluid.

Figure 5:
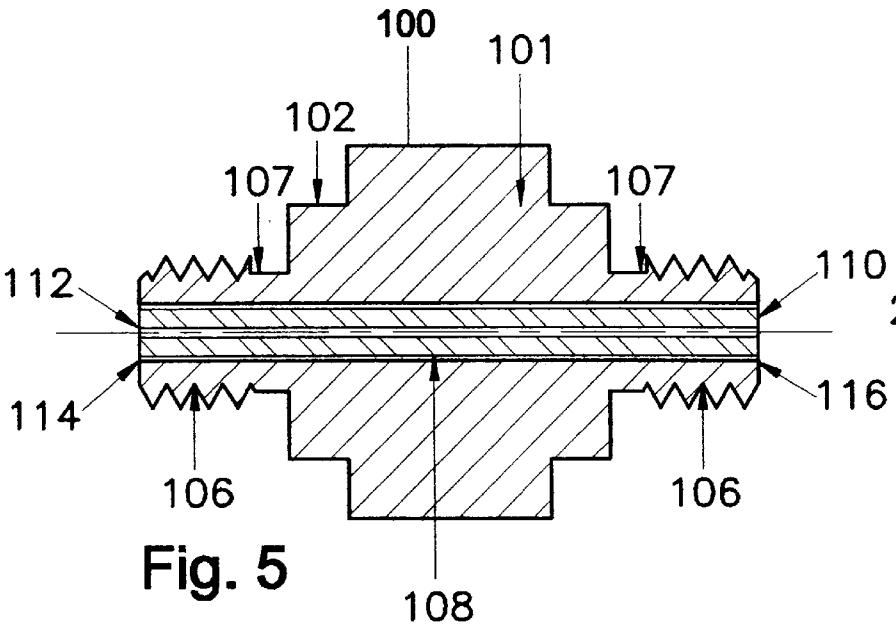
FIG. 5 is a cross-sectional view of the reversible spray nozzle showing one embodiment of the delivery channel of the invention.

FIG. 5 describes a cross-sectional view of one exemplary embodiment of a spray nozzle of the invention. Nozzle body 101 is constructed of a single piece of metal stock, such as brass, stainless steel, or any other corrosive resistant material such as carbon fibers or plastic. Nozzle body 101 is drilled, or formed, to have a generally smooth, cylindrical channel 108 therewithin extending the length of nozzle body 101, channel 108 being sized to receive flow tube 110. Flow tube 110 is fabricated to have a delivery channel 112 for providing a flow path for the fluid. Flow tube 110 extends the length of channel 108, and is secured in channel 108 by rolling over the edges of nozzle body 101 at points 114 and 116. Flow tube 110 is fabricated preferably by extruding a length of stainless steel tubing. One example of such a commercially available tubing is 316 stainless steel extruded surgical tubing with an orifice extending the length of flow tube 110 having an inside diameter of six one-thousandths of an inch (0.006 inch) and an outside diameter of sixty-one one-thousandths of an inch (0.061 inch). The invention is not limited to the material that is used for flow tube 110, the restrictions of useful material being limited to a non-corrosive material, other such materials being, but not restricted to, carbon fibers, plastic, etc. The method of extruding such tubes is well known to those of ordinary skill in the extrusion arts.

Figure 6:
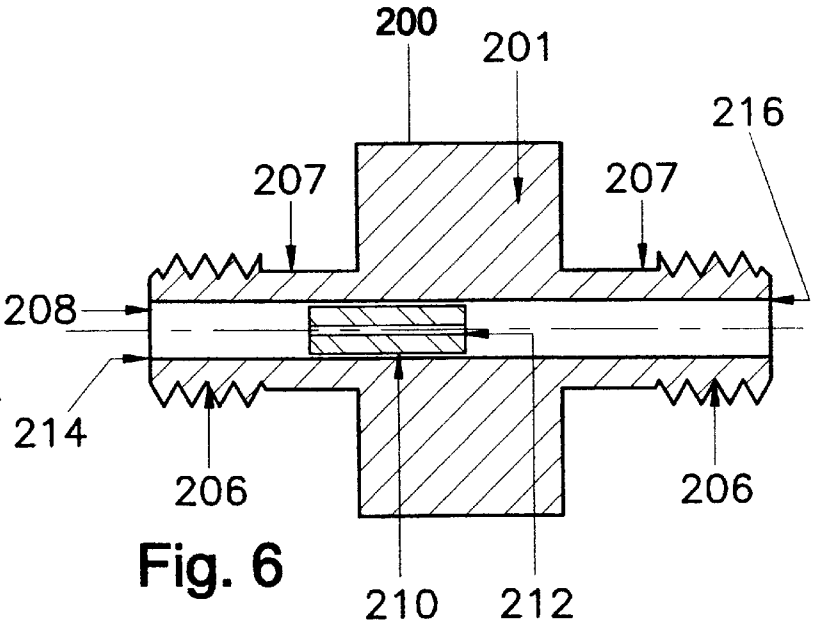
FIG. 6 is a cross-sectional view of the reversible spray nozzle showing a second embodiment of the delivery channel with a slideable piston.

FIG. 6 describes a cross-sectional view of a second exemplary embodiment of a spray nozzle of the invention. Nozzle body 201 is also constructed of a single piece of metal stock, such as brass, stainless steel, or any other corrosive resistant material, such as carbon fibers or plastic. Nozzle body 201 is drilled, or formed, to have a generally smooth, cylindrical channel 208 extending the length of nozzle body 201, with channel 208 being sized to receive flow tube 210. Flow tube 210 is fabricated to have a delivery channel 212 for providing a flow path for the fluid. In this exemplary embodiment, flow tube 210 is selected such that its has an appropriate length of one hundred twenty-five one-thousandths of an inch (0.125 inch). Such a length is obtained by cutting a selected extruded surgical tubing to an approximate length of one hundred thirty-five one-thousandths of an inch (0.135 inch) to yield a finished length of one hundred twenty-five one-thousandths of an inch (0.125 inch). Flow tube 210 is similarly secured in channel 208 by rolling over the edges of nozzle body 201 at points 214 and 216. Channel 208 and flow tube 210 are complementarily sized so that flow tube 210 fits snugly within channel 208, but is movable the length of channel 208 so that when spray nozzle 200 is reversibly inserted in a fluid dispersing system, the fluid pressure will impel flow tube 210 the length of channel 208 with sufficient force to assist in the dislodging of fluid impurities from the delivery channel 212 of flow tube 210. In a standard pressure fluid dispersal system, the pressure transient of the fluid is in the order of 4,890 feet/second, consequently, in a typical 25 foot delivery system, the fluid front will arrive at the last nozzle of the system in approximately 0.005 seconds, creating sufficient impetus to dislodge the fluid impurities. The exact length of flow tube 210 is not critical to its operation, however, it must have sufficient length versus diameter that it will not become lodged in channel 208, yet not be so long that its travel length eliminates the effect of being impelled the length of channel 208. Such determinations are well within the capabilities of one of ordinary skill in the art.

While the present description contains much specificity, this should not be construed as limitations on the scope of the invention, but rather as exemplifications of one/some preferred embodiment/s thereof. Accordingly, the scope of the invention should not be determined by the specific embodiments illustrated herein. The full scope of the invention is further illustrated by the claims appended hereto.

I claim:

1. A reversible spray nozzle for use in a fluid dispersing system comprising:

a. a nozzle portion defining a cylindrical channel therewithin, the nozzle portion having opposing ends, the opposing ends threaded for communicating with a fluid dispersal system, the cylindrical channel extending the length of the nozzle portion, the cylindrical channel for receiving a flow tube, the flow tube having a selected length;

b. the flow tube defining a delivery channel, the delivery channel extending the length of the flow tube, the delivery channel for providing a flow path for a fluid; and wherein the flow tube is slideably disposed within the nozzle portion.

2. The spray nozzle of claim 1 wherein the flow tube is fabricated of stainless steel.

3. The spray nozzle of claim 1 wherein the nozzle portion is fabricated from the group of stainless steel, brass, carbon fiber, or plastic.

4. The spray nozzle of claim 1 wherein the circumference of the delivery channel is about 0.006 inch in diameter.

5. The spray nozzle of claim 1 wherein the circumference of the cylindrical channel of the nozzle portion is about 0.15 inch in diameter.

6. The spray nozzle of claim 1 wherein the length of the flow tube is less than half the length of the cylindrical channel in the nozzle portion.

7. A reversible spray nozzle for use in a fluid dispersing system comprising:

a. a nozzle portion defining a cylindrical channel therewithin, the nozzle portion having opposing ends, the opposing ends threaded for communicating with a fluid dispersal system, the cylindrical channel extending the length of the nozzle portion, the cylindrical channel for receiving a flow tube, the flow tube having a selected length;

b. the flow tube defining a delivery channel, the delivery channel extending the length of the flow tube, the delivery channel for providing a flow path for a fluid; and wherein the flow tube is slideably disposed within the nozzle portion and the length of the flow tube is less than half the length of the cylindrical channel in the nozzle portion.

8. The spray nozzle of claim 7 wherein the flow tube is fabricated of stainless steel.

9. The spray nozzle of claim 7 wherein the nozzle portion is fabricated from the group of stainless steel, brass, carbon fiber or plastic.

10. The spray nozzle of claim 7 wherein the circumference of the delivery channel is about 0.006 inch in diameter.

11. The spray nozzle of claim 7 wherein the circumference of the cylindrical channel of the nozzle portion is about 0.15 inch in diameter.

* * * * *